United States Patent [19]

Schultz

[11] Patent Number: 4,587,682

[45] Date of Patent: May 13, 1986

[54] SLEEPING BAG

[76] Inventor: Dennis B. Schultz, 418 N. Van Buren, East Dundee, Ill. 60110

[21] Appl. No.: 603,338

[22] Filed: Apr. 24, 1984

[51] Int. Cl.[4] ..... A47G 9/08

[52] U.S. Cl. ..... 5/413; 224/156; 383/4

[58] Field of Search ..... 5/413, 420, 502; 2/69.5; 190/2; 224/156, 153, 151; 383/4

[56] References Cited

U.S. PATENT DOCUMENTS

| | | | |
|---|---|---|---|
| 33,385 | 10/1861 | Frodsham et al. . | |
| 748,288 | 12/1903 | Klein | 224/156 |
| 1,102,200 | 6/1914 | Miller . | |
| 1,255,481 | 2/1918 | Spranger | 5/462 |
| 1,930,942 | 10/1933 | Pringle | 5/344 |
| 1,992,772 | 2/1935 | Ross | 224/46 |
| 2,338,226 | 1/1944 | Bauer . | |
| 2,368,220 | 1/1945 | Hinds . | |
| 2,594,438 | 4/1952 | Howe . | |
| 2,971,205 | 2/1961 | Shultz | 2/69.5 |
| 3,483,575 | 12/1969 | McCarthy | 2/69.5 |
| 3,541,620 | 11/1970 | Chapuis . | |
| 4,035,855 | 7/1977 | Kim | 224/156 |
| 4,188,988 | 2/1980 | Agyagos | 5/417 |
| 4,238,871 | 12/1980 | Cannon | 5/413 |
| 4,468,810 | 8/1984 | Longo | 5/417 |
| 4,516,668 | 5/1985 | Grayek | 5/417 |

FOREIGN PATENT DOCUMENTS

| | | | |
|---|---|---|---|
| 7809879 | 4/1980 | Netherlands | 5/413 |

*Primary Examiner*—Alexander Grosz

*Attorney, Agent, or Firm*—Powell L. Sprunger

[57] ABSTRACT

A sleeping bag comprising, first and second panels, with one of the panels overlying the other panel and with the panels having a lower portion, an upper portion, and side edges. The bag has a first closing device for closing the side edges of the first and second panels, with the upper portion of the panels being inverted and tucked between the adjoining portion of the panels to define a pocket and an opening communicating with the pocket to receive and stow articles. The bag has a second device for closing the opening.

34 Claims, 11 Drawing Figures

FIG. 1
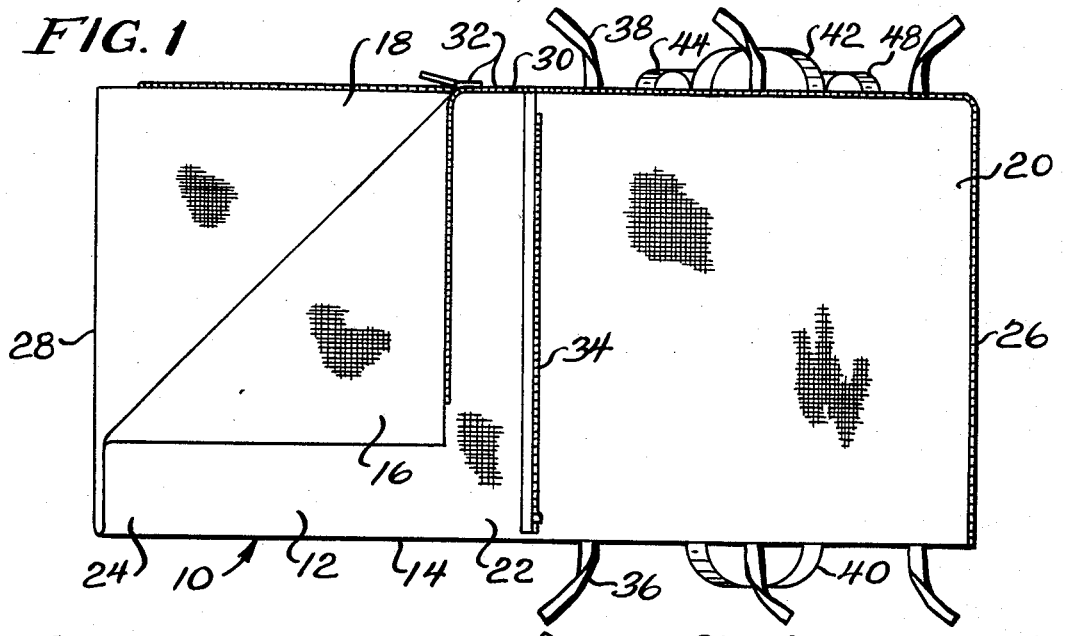
FIG. 2
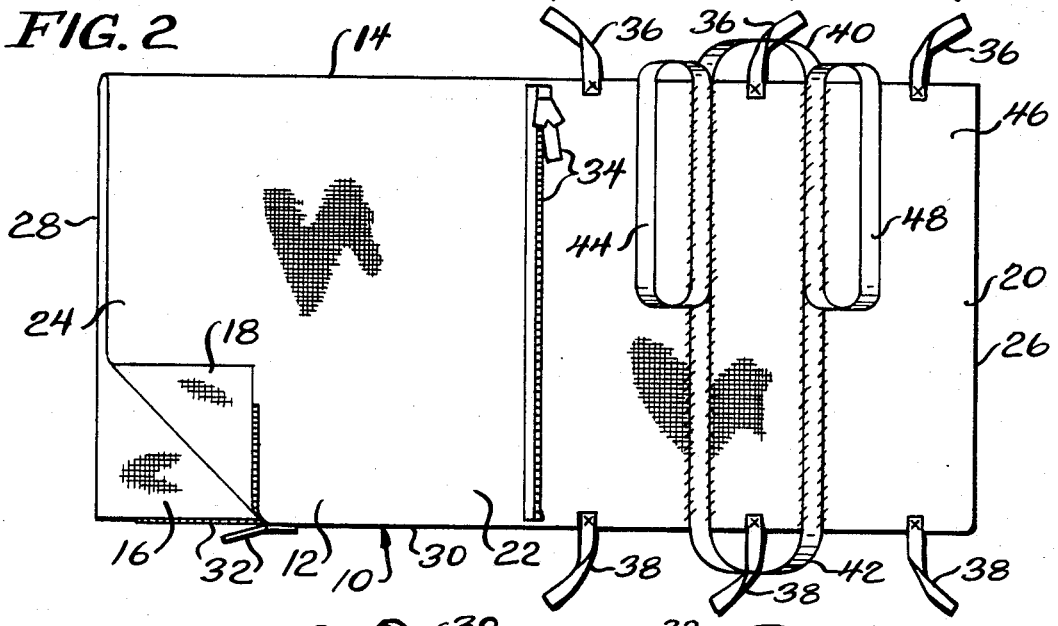
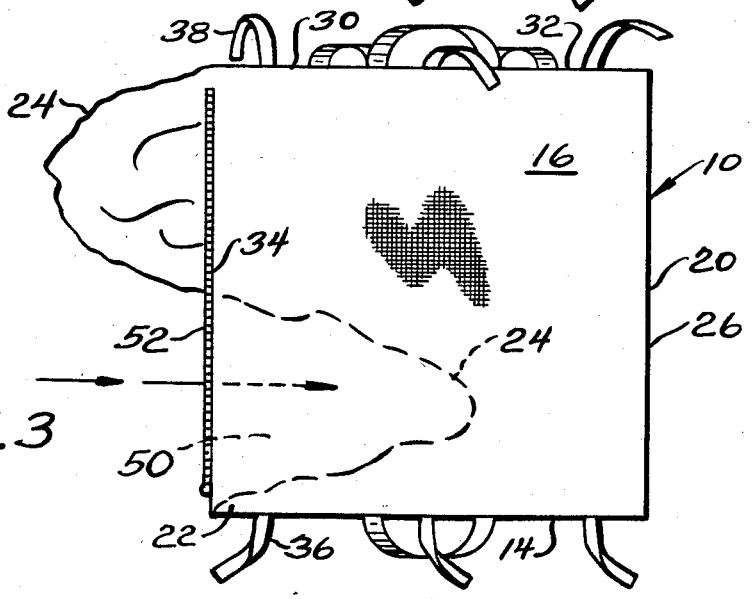
FIG. 3

FIG. 4
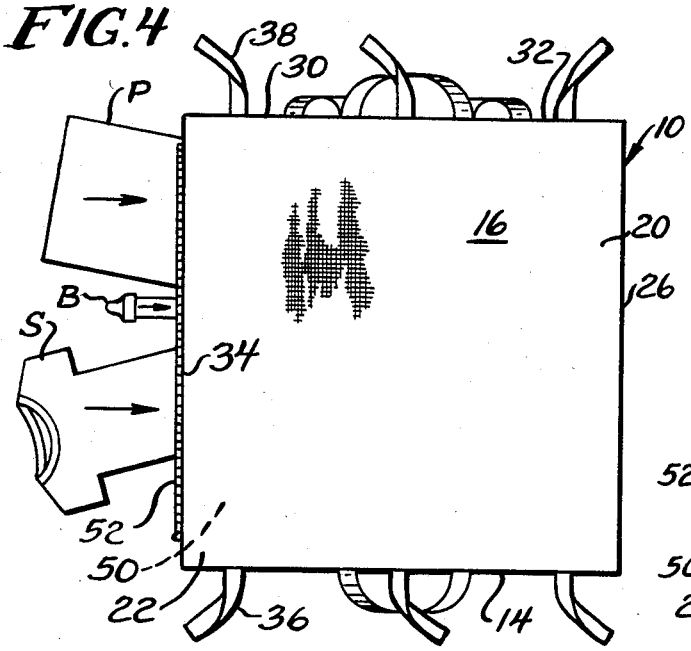
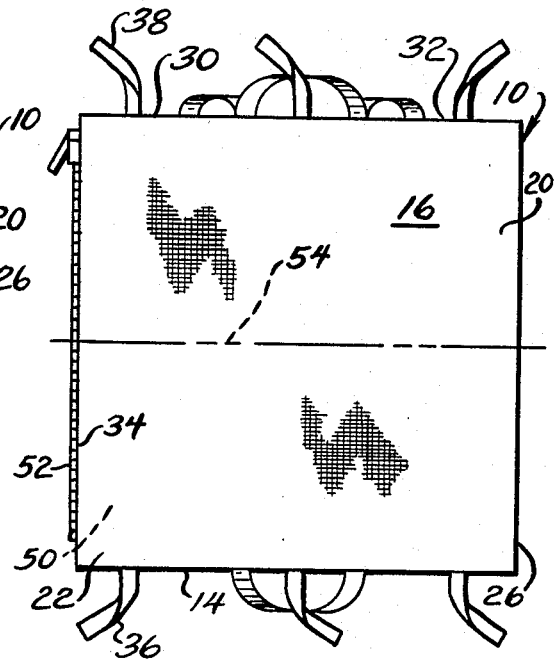
FIG. 5
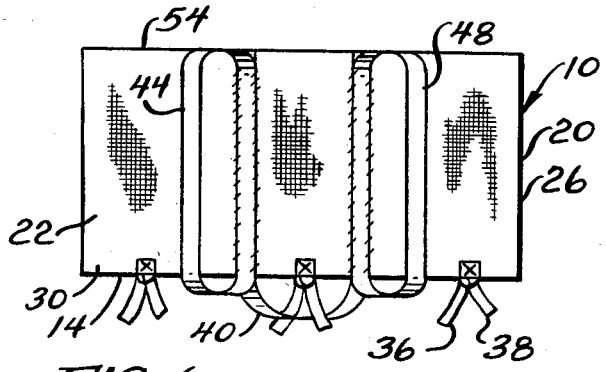
FIG. 6
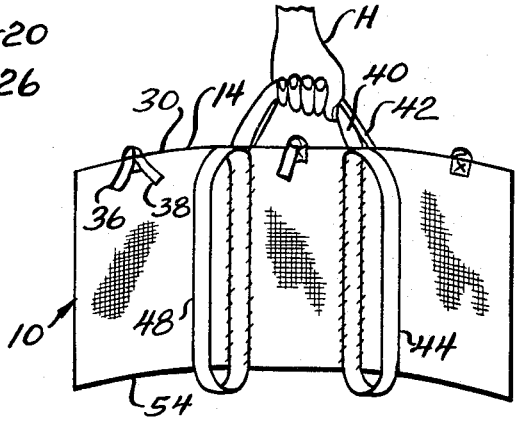
FIG. 7
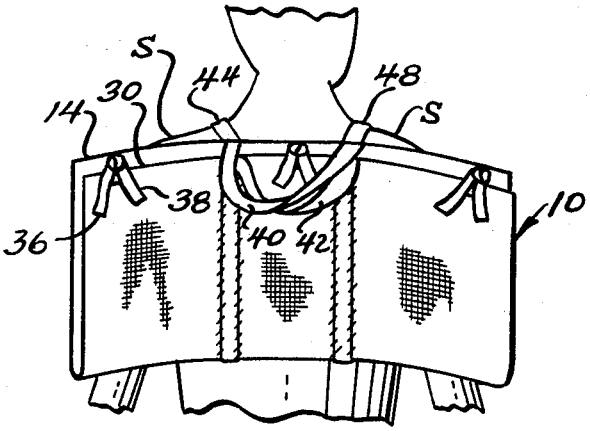
FIG. 8

FIG. 9
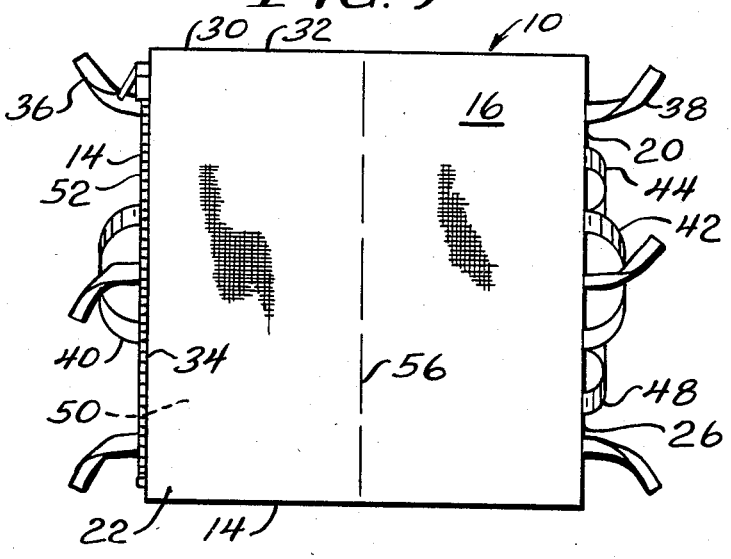
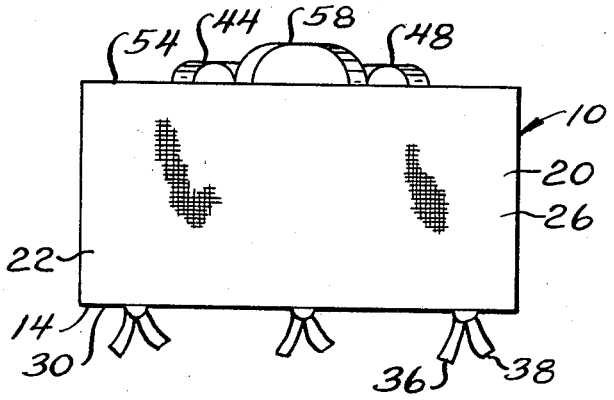
FIG. 10
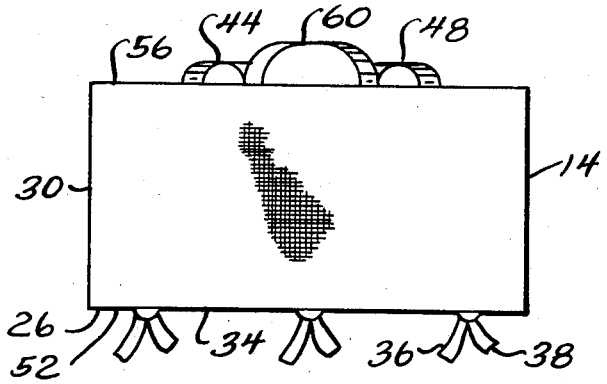
FIG. 11

SLEEPING BAG

BACKGROUND OF THE INVENTION

The present invention relates to sleeping bags.

In the past, sleeping bags have been well known. Such sleeping bags normally comprise first and second padded panels, with one of the panels overlying the other of the panels. The bags have a zipper to close a lower edge and a side edge of the panels, and the panels are rolled up and tied in a suitable manner when not in use. Such sleeping bags are often used during hiking or camping, and during such times it is often necessary for the user to carry the bag and other articles, such as food, clothing or a pillow, which is frequently inconvenient and difficult.

SUMMARY OF THE INVENTION

The present invention relates to improved sleeping bags.

The sleeping bag of the present invention comprises, first and second padded panels, with one of the panels overlying the other panel, and with the panels having a lower portion, an upper portion, and side edges. The bag has first means for closing the side edges of the first and second panels, with the upper portion of the panels being inverted and tucked between an adjoining portion of the panels to define a pocket and an opening. The bag has second means for closing the opening.

A feature of the present invention is that articles may be placed through the opening into the pocket for storage in the pocket.

Yet another feature of the invention is that the second closing means closes the opening of the pocket in order to retain the articles in the pocket.

A further feature of the invention is that the first and second panels may be folded along a central fold line to reduce the dimensions of the sleeping bag.

Still another feature of the invention is that the sleeping bag may have a pair of straps secured adjacent edge portions of the panels for carrying the bag.

Yet another feature of the invention is that the bag may have a pair of straps secured to the folded panels to receive the user's shoulders in order to carry the bag.

Further features will become more fully apparent in the following description of the embodiments of this invention and from the appended claims.

DESCRIPTION OF THE DRAWINGS

In the drawings:

FIG. 1 is a top plan view of a sleeping bag of the present invention;

FIG. 2 is a bottom plan view of the sleeping bag of FIG. 1;

FIG. 3 is a top plan view illustrating an upper portion of the bag inverted into an adjoining portion of the bag.

FIG. 4 is a top plan view illustrating use of the bag to store articles;

FIG. 5 is a top plan view illustrating a zipper to close an opening of the inverted bag;

FIG. 6 is a top plan view illustrating the bag folded into a compact configuration;

FIG. 7 is an elevational view showing a pair of straps utilized to carry the bag;

FIG. 8 is an elevational view illustrating a pair of straps utilized to receive the shoulders of the user in order to carry the bag;

FIG. 9 is a top plan view illustrating another folding pattern for the bag; and

FIGS. 10 and 11 are alternate embodiments of the sleeping bag.

DESCRIPTION OF THE PREFERRED EMBODIMENTS

Referring now to FIGS. 1 and 2, there is shown a sleeping bag generally designated 10 having a generally rectangular padded panel 12. The panel 12 may be padded with any suitable material known to the art, such as down, in order to keep the user warm during use of the bag 10.

The panel 12 is folded along a first central longitudinally extending fold line 14 in order to define a first panel 16 and a second panel 18. As shown, the first panel 16 overlies the second panel 18 in the folded configuration of the bag 10. The folded panels 16 and 18 have a lower portion 20, a central portion 22, and an upper portion 24. The first and second panels 16 and 18 have a laterally extending lower or side edge 26, a laterally extending upper edge 28, and a side edge 30 extending longitudinally between the lower edge 26 and upper edge 28, with the fold line 14 also extending longitudinally between the lower edge 26 and upper edge 28.

The bag 10 has a first zipper 32 extending along the lower edge 26 and side edge 30, such that the lower edge 26 and side edge 30 may be closed by the first zipper 32 while leaving the upper edge 28 open in order to receive the user during use of the bag 10. As shown, the bag 10 has a laterally extending second zipper or closing means 34 adjacent a longitudinal mid point of the first and second panels 16 and 18 in the central portion 22 of the bag 10. In a preferred form, the second zipper 34 extends substantially between the side edge 30 and fold line 14.

The bag 10 has a plurality of spaced first ties 36 extending from a location adjacent the fold line 14 between the second zipper 34 and lower edge 26, and a plurality of spaced second ties 38 extending from a location adjacent the side edge 30 between the second zipper 34 and lower edge 26, with the first ties 36 being aligned with the second ties 38 for a purpose which will be described below. The bag 10 has a first strap 40 secured to spaced portions adjacent the fold line 14, and a second strap 42 secured to spaced portions adjacent the side edge 30. The bag 10 has a third strap 44 secured to laterally spaced portions of an outer surface 46 of the panels, and a spaced fourth strap 48 secured to laterally spaced portions of the outer surface 46 of the panels. In a preferred form, the third and fourth straps 44 and 48 are adjustable in length.

In use, the first zipper 32 is zipped to a location in the central portion 22 adjacent the second zipper 34. With reference to FIG. 3, the upper portion 24 of the panels 16 and 18 is inverted and tucked between an adjoining portion of the panels 16 and 18 until all the upper portion 24 is inverted into the bag 10 in order to define a pocket 50 between the panels 16 and 18 and an opening 52 adjacent the second zipper 34 communicating with the pocket 50. Next, with reference to FIG. 4, various articles, such as a pillow P, a baby bottle B, or a shirt S, may be passed through the opening 52 into the pocket 50 between the first and second panels 16 and 18. With reference to FIG. 5, once the articles are in the bag 10, the second zipper 34 may be utilized to close the opening 52 in order to retain the articles in the pocket 50. With reference to FIGS. 5 and 6, the first and second panels 16 and 18 are then folded along a central longitudinal second fold line 54 which extends between the closed opening 52 and the lower edge 26 in order to place the side edge 30 of the panels adjacent the first fold line 14. With reference to FIG. 6, the first and second ties 36 and 38 may be secured together in order to retain the side edge 30 adjacent the first fold line 14 of the folded panels. In suitable form, snap fasteners or hook and loop fastener strips may be utilized in lieu of the ties 36 and 38 in order to secure the panels together. With reference to FIG. 9, in an alternative form after closing the opening 52 by the second zipper 34, the first and second panels 16 and 18 may be folded along a central lateral third fold line 56 which extends between the side edge 30 and first fold line 14 in order to place the opening 52 and second zipper 34 adjacent the lower edge 26. In this embodiment, the ties 36 and strap 40 are located adjacent the second zipper 34 and the ties 38 and strap 42 are located adjacent the lower edge 26. The straps 44 and 48 are secured to spaced portions of the outer surface of the bag. As before, the ties 36 and 38 may be secured together in order to retain the bag in the folded configuration about fold line 56. However, in the embodiment of FIG. 9 it should be noted that it is not necessary to close the opening 52 since it is located at the top of the bag in the folded configuration of the bag.

With reference to FIG. 7, the first and second straps 40 and 42 may be retained by a user's hand H in order to conveniently carry the bag 10 with the stowed articles in place in the bag 10. Alternatively, with reference to FIG. 8, the user's shoulders S may be received in the third and fourth straps 44 and 48 in order to carry the bag on the user's back with the stored articles in place.

Thus, in accordance with the present invention, a sleeping bag 10 is disclosed in which various articles may be stored and carried in a convenient manner. Suitable uses of the sleeping bag 10 of the present invention will be described as follows. For campers and hikers, the bag 10 may be utilized for sleeping, and as a back pack in order to retain and carry suitable articles. For children, the sleeping bag may be utilized as an overnight bag and to carry articles for slumber parties. For college students, the sleeping bag may be utilized to sleep during traveling and in order to carry articles during the traveling period. For the military, the sleeping bag may be utilized to sleep in the bag and as a back pack in order to carry suitable articles. For families, the sleeping bag 10 may be utilized as a travel bag in order to sleep and as a back pack in order to retain and carry suitable articles. For mothers and infants, the sleeping bag 10 may be utilized in order to sleep and to store infant care articles, such as diapers and feeding supplies.

With reference to FIG. 10, in an alternative form a strap 58 may be secured to spaced portions of the bag adjacent the second longitudinal fold line 54 to carry the bag, and the straps 44 and 48 may also be located adjacent the fold line 54 to receive the shoulders. As before, the ties 36 and 38 may be utilized to secure the side edge 30 and fold line 14 together. With reference to FIG. 11, in another form a strap 60 may be secured to spaced portions of the bag adjacent the third lateral fold line 56 to carry the bag, and the straps 44 and 48 may also be located adjacent the fold line 56 to receive the shoulders. The ties 36 and 38 may be utilized to secure the lower edge 26 and second zipper 34 together.

The foregoing detailed description is given for clearness of understanding only, and no unnecessary limitations should be understood therefrom, as modifications will be obvious to those skilled in the art.

I claim:

1. A sleeping bag, comprising:

first and second padded panels, with one of the panels overlying the other panel, said panels having a lower portion, an upper portion, and side edges;

first means for closing the side edges of the first and second panels, with the upper portion of said panels being inverted and tucked between an adjoining portion of said panels to define a pocket and an opening communicating with the pocket to receive and store articles; and second means for closing said opening.

2. The bag of claim 1 wherein the first and second closing means comprise zippers.

3. The bag of claim 1 wherein said first and second panels include a central longitudinally extending fold.

4. The bag of claim 3 including means for securing edge portions of the folded panels together.

5. The bag of claim 4 wherein the securing means comprises ties.

6. The bag of claim 4 including a pair of straps secured to portions of the folded panels to receive the user's shoulders.

7. The bag of claim 4 including a pair of straps secured adjacent said edge portions for carrying the bag.

8. The bag of claim 1 wherein said first and second panels include a central laterally extending fold.

9. The bag of claim 8 including means for securing edge portions of the folded panels together.

10. The bag of claim 9 wherein the securing means comprises ties.

11. The bag of claim 9 including a pair of straps secured to portions of the folded panels to receive the user's shoulders.

12. The bag of claim 9 including a pair of straps secured adjacent said edge portions for carrying the bag.

13. A sleeping bag, comprising:

first and second padded panels, with one of the panels overlying the other panel, said panels having a lower portion, a central portion, an upper portion, and side edges extending between the lower portion and upper portion;

first means for closing the side edges of the first and second panels, with the first closing means being closed between the lower portion and central portion, with the upper portion of said panels being inverted and tucked between an adjoining portion of the panels to define a pocket and an opening in the central portion communicating with the pocket to receive and store articles;

second means for closing said opening, with said panels being folded about a central longitudinally extending fold line; and means for securing edge portions of the folded panels together.

14. The bag of claim 13 wherein the first and second closing means comprise zippers.

15. The bag of claim 13 wherein the securing means comprises ties.

16. The bag of claim 13 including a pair of straps secured adjacent spaced portions of said edge portions to carry the bag.

17. The bag of claim 13 including a pair of straps secured to spaced portions of an outer surface of the folded panels to receive the user's shoulders.

18. A sleeping bag, comprising:

a generally rectangular padded panel, said panel being folded along a first central longitudinally extending fold line defining first and second panels, with one of said panels overlying the other of said panels, said first and second panels having a lower portion, a central portion, and an upper portion, said first and second panels having laterally extending lower and upper edges, and a side edge extending between the lower edge and the upper edge;

a first zipper extending along the lower edge and the side edge between the lower edge and upper edge, said first zipper being zipped to the central portion of said first and second panels, with the upper portion of said first and second panels being inverted and tucked between an adjoining portion of the first and second panels until the panels define an opening in the central portion of the panels communicating with a pocket between the panels to receive and store articles;

a laterally extending second zipper in the central portion of the first and second panels to close the opening, said first and second panels being folded along a central longitudinal second fold line extending between the closed opening and the lower edge to place the side edge of the panels adjacent the first fold line; and means for securing the side edge and first fold line of the first and second panels together.

19. The bag of claim 18 wherein the securing means comprises a plurality of ties extending from the first fold line and side edge of the first and second panels.

20. The bag of claim 18 including a pair of straps secured to spaced portions of the first fold line and side edge of the first and second panels to carry the bag.

21. The bag of claim 18 including a pair of straps secured to spaced portions of an outer surface of the first and second panels to receive the user's shoulders.

22. The bag of claim 18 wherein the second zipper is located adjacent a longitudinal mid point of the first and second panels between the lower and upper edges.

23. A sleeping bag, comprising;

first and second padded panels, with one of the panels overlying the other panel, said panels having a lower portion, a central portion, an upper portion, and side edges extending between the lower portion and upper portion;

first means for closing the side edges of the first and second panels, with the first closing means being closed between the lower portion and central portion, with the upper portion of said panels being inverted and tucked between an adjoining portion of the panels to define a pocket and an opening in the central portion communicating with the pocket to receive and stow articles;

second means for closing said opening, with said panels being folded about a central laterally extending fold line; and means for securing edge portions of the folded panels together.

24. The bag of claim 23 wherein the first and second closing means comprise zippers.

25. The bag of claim 23 wherein the securing means comprises ties.

26. The bag of claim 23 including a pair of straps secured adjacent spaced portions of said edge portions to carry the bag.

27. The bag of claim 23 including a pair of straps secured to spaced portions of an outer surface of the folded panels to receive the user's shoulders.

28. A sleeping bag, comprising:

a generally rectangular padded panel, said panel being folded along a first central longitudinally extending fold line defining first and second panels, with one of said panels overlying the other of said panels, said first and second panels having a lower portion, a central portion, and an upper portion, said first and second panels having laterally extending lower and upper edges, and a side edge extending between the lower edge and the upper edge;

a first zipper extending along the lower edge and the side edge between the lower edge and upper edge, said first zipper being zipped to the central portion of said first and second panels, with the upper portion of said first and second panels being inverted and tucked between an adjoining portion of the first and second panels until the panels define an opening in the central portion of the panels communicating with a pocket between the panels to receive and stow articles;

a laterally extending second zipper in the central portion of the first and second panels to close the opening, said first and second panels being folded along a central lateral second fold line extending between the first fold line and the side edge to place the closed opening of the panels adjacent the lower edge; and means for securing the closed opening and lower edge of the first and second panels together.

29. The bag of claim 28 wherein the securing means comprises a plurality of ties extending from adjacent the closed opening and lower edge of the first and second panels.

30. The bag of claim 28 including a pair of straps secured to spaced portions adjacent the closed opening and lower edge of the first and second panels to carry the bag.

31. The bag of claim 28 including a pair of straps secured to spaced portions of an outer surface of the first and second panels to receive the user's shoulders.

32. The bag of claim 28 wherein the second zipper is located adjacent a longitudinal mid point of the first and second panels between the lower and upper edges.

33. A sleeping bag, comprising:

first and second padded panels, with one of the panels overlying the other panel, said panels having a lower portion, an upper portion, and side edges;

means for closing the side edges of the first and second panels, with the upper portion of said panels being inverted and tucked between an adjoining portion of said panels to define a pocket and an opening communicating with the pocket to receive and store articles; and means for closing a sufficient portion of the opening to prevent articles from falling out of the pocket.

34. A sleeping bag, comprising:

first and second padded panels, with one of the panels overlying the other panel, said panels having a first end portion, a second end portion, and side edges;

means for closing the side edges of the first and second panels, with the first end portion of said panels being inverted and tucked between an adjoinging portion of said panels to define a pocket and an opening communicating with the pocket to receive and store articles; and means for closing said opening.

* * * * *